US007237692B2

(12) United States Patent
Bodum

(10) Patent No.: US 7,237,692 B2
(45) Date of Patent: Jul. 3, 2007

(54) POURER FOR A LIQUID CONTAINER

(75) Inventor: Jørgen Bodum, St. Niklausen (CH)

(73) Assignee: Pi-Design AG, Triengen (CH)

( * ) Notice: Subject to any disclaimer, the term of this patent is extended or adjusted under 35 U.S.C. 154(b) by 407 days.

(21) Appl. No.: 10/878,369

(22) Filed: Jun. 29, 2004

(65) Prior Publication Data

US 2005/0279762 A1 Dec. 22, 2005

(30) Foreign Application Priority Data

Jun. 21, 2004 (DE) ..... 20 2004 009 760 U

(51) Int. Cl.
*B67D 1/16* (2006.01)

(52) U.S. Cl. ..... 222/109; 222/566

(58) Field of Classification Search ..... 220/109, 220/110, 111, 571, 321.3, 565, 566, 694, 220/726, 727, 734; 215/54, 292, 310, 392, 215/393; 222/567–574
See application file for complete search history.

(56) References Cited

U.S. PATENT DOCUMENTS 4,047,648 A * 9/1977 Croyle ..... 222/498
4,128,189 A * 12/1978 Baxter ..... 222/109
4,550,862 A * 11/1985 Barker et al. ..... 222/109
4,890,770 A * 1/1990 Haga et al. ..... 222/109
4,934,548 A * 6/1990 Hsu ..... 215/307
5,566,862 A * 10/1996 Haffner et al. ..... 222/111
6,398,076 B1 * 6/2002 Giblin et al. ..... 222/109
6,659,310 B1 * 12/2003 Wolpert ..... 222/109
6,845,885 B2 * 1/2005 Morgenroth ..... 222/109
6,976,610 B2 * 12/2005 Rigel ..... 222/523
2002/0011498 A1 * 1/2002 Giblin et al. ..... 222/109

* cited by examiner

*Primary Examiner*—Lien M. Ngo
(74) *Attorney, Agent, or Firm*—Sughrue Mion, PLLC

(57) ABSTRACT

A pourer for a liquid container is disclosed. This pourer has a base element (1, 2) with a supply duct (13) and also a pouring element (5) with a pouring duct (53). The pouring element (5) is connected swivellably to the base element (1, 2) in order to connect the pouring duct (53) to the supply duct (13). The pouring element (5) is surrounded by a collecting cup (4). A return means (57) for returning liquid from the collecting cup (4) into the liquid container is also present. In order to improve hygiene and to avoid dirt entering the liquid container, the collecting cup (4) is connected rigidly to the pouring element (5). The pourer is suitable in particular as an oil dispenser.

10 Claims, 4 Drawing Sheets

POURER FOR A LIQUID CONTAINER

TECHNICAL FIELD

The present invention relates to a pourer for a liquid container. Such a pourer can be designed in particular as a dispenser for edible oil.

BACKGROUND OF THE INVENTION

Pourers of the kind mentioned in the introduction are known from practice. In a known pourer, which is designed as an oil dispenser, a base element is inserted into a specially adapted edible-oil bottle. A pouring element is attached swivellably to the base element. A supply duct in the base element and a pouring duct in the pouring element can be made to communicate with one another by turning the pouring element against the base element. Oil can then be poured. In order to collect oil which runs down on the outside of the pouring element after pouring, a collecting cup is arranged around the pouring element. The oil thus collected passes back into the oil bottle through a return duct.

In the known oil dispenser, the collecting cup is connected rigidly to the base element. When the oil dispenser is opened and closed, the pouring element is therefore rotated relative to the collecting cup. During these movements, oil can enter the gap between the pouring element and the collecting cup. The gap can be cleaned only with difficulty, so that oil may come into contact with dirt located in the gap and convey it into the oil bottle. Moreover, the oil which has entered the gap can be removed again only with difficulty, becomes rancid and viscous over time and thus impairs the functioning and the practical value of the oil dispenser. In particular, such an oil dispenser is hygienically unsatisfactory. Similar disadvantages arise if a pourer with such a construction is used for, for example, vinegar or other liquids.

DESCRIPTION OF THE INVENTION

It is therefore an object of the present invention to produce a pourer for a liquid container, which avoids these disadvantages and is hygienically more satisfactorily designed.

This object is achieved by a pourer for a liquid container, comprising

- a base element with a supply duct,
- a pouring element with a pouring duct, the pouring element and the base element being interconnected swivellably about a common axis in such a way that there is a swivelling range in which the supply duct and the pouring duct communicate with one another,
- a collecting cup surrounding the pouring element at least partly and being connected rigidly to the pouring element, and
- a return means for returning liquid from the collecting cup into the liquid container.

According to the invention, the collecting cup is connected rigidly to the pouring element. As the collecting cup is not movable against the pouring element, the hygienic and practical problems mentioned above are avoided.

The pourer according to the invention can be used especially advantageously as a dispenser for edible oil.

BRIEF DESCRIPTION OF THE DRAWINGS

The invention is described in detail below with reference to the drawings, in which.

DETAILED DESCRIPTION OF THE INVENTION

Figure 1:
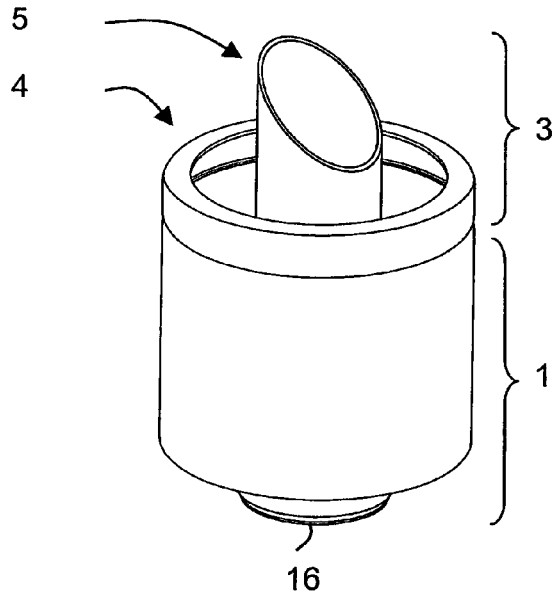
FIG. 1 shows a perspective view of a pourer.
Figure 2:
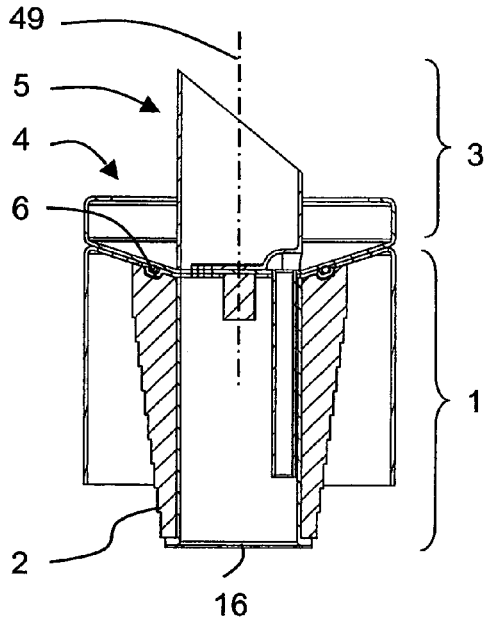
FIG. 2 shows the pourer in FIG. 1 in cross section.
Figure 3:
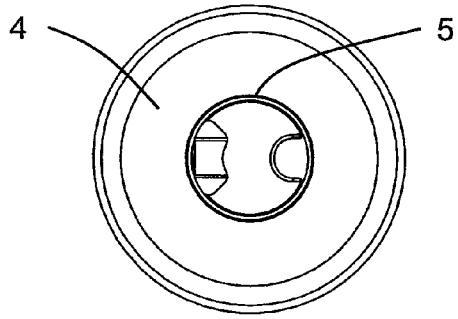
FIG. 3 shows the pourer in FIG. 1 in a top view.
Figure 4:
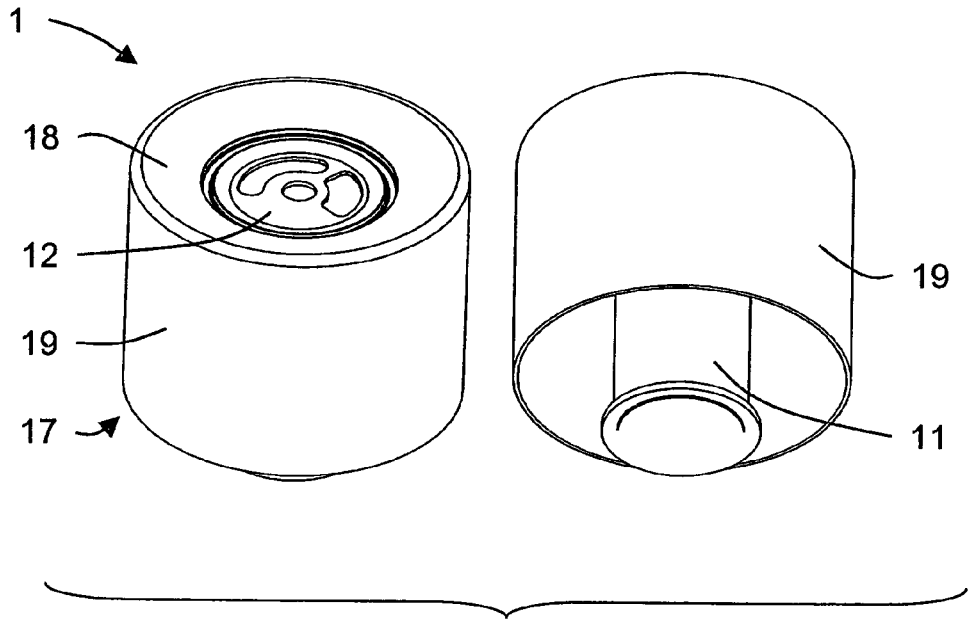
FIG. 4 shows a perspective view of a lower part.
Figure 5:
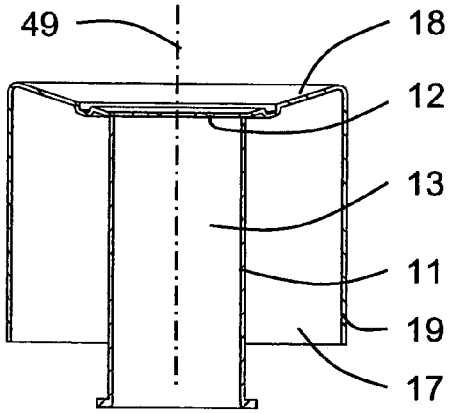
FIG. 5 shows the lower part in FIG. 4 in cross section.
Figure 6:
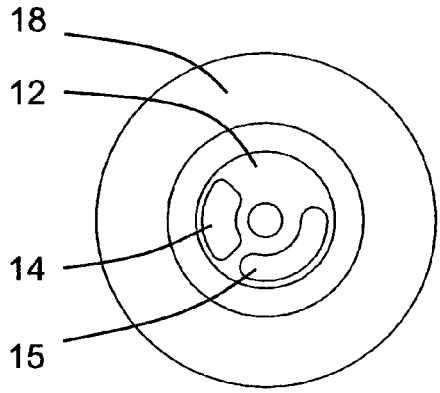
FIG. 6 shows the lower part in FIG. 4 in a top view.
Figure 7:
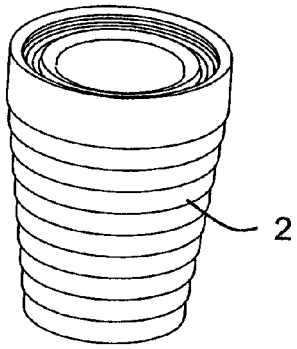
FIG. 7 shows a perspective view of an adapter.
Figure 8:
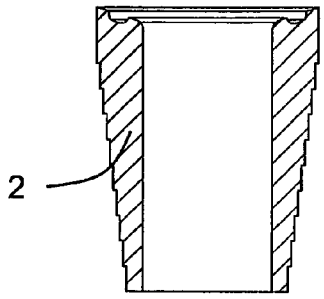
FIG. 8 shows the adapter in FIG. 7 in cross section.
Figure 9:
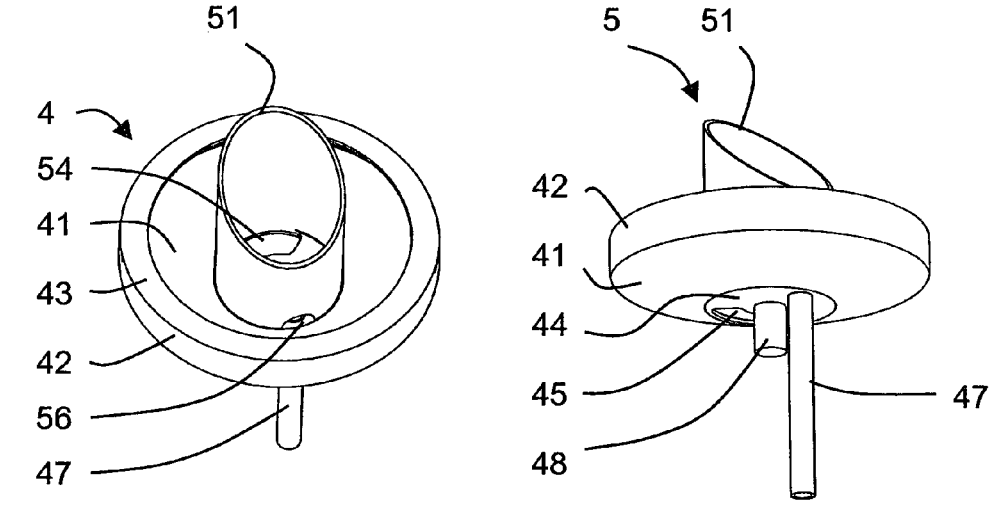
FIG. 9 shows two perspective views of an upper part.
Figure 10:
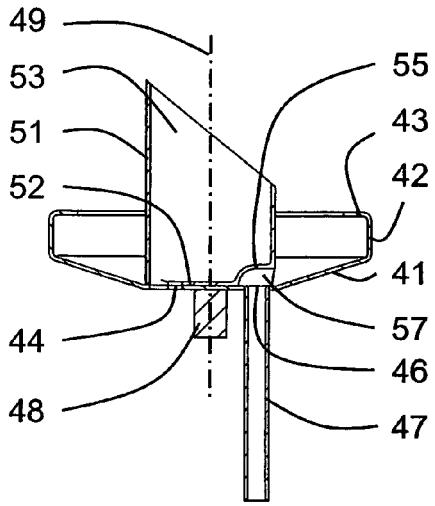
FIG. 10 shows the upper part in FIG. 9 in cross section.
Figure 11:
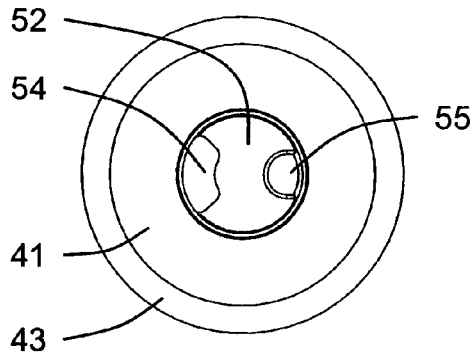
FIG. 11 shows the upper part in FIG. 10 in a top view.

FIGS. 1 to 3 show different illustrations of a pourer according to the invention. The pourer illustrated is designed as a dispenser for edible oil and intended for use on an oil bottle. The pourer consists of a lower part 1, illustrated on its own in FIGS. 4 to 6, an adapter 2, illustrated on its own in FIGS. 7 and 8, which is pushed onto the lower part 1, and an upper part 3, illustrated in FIGS. 9 to 11.

The lower part 1 comprises a central, circular cylindrical supply pipe 11 which is closed at its upper end by a first plate 12. The supply pipe 11 and the first plate 12 together delimit a supply duct 13. A supply opening 14 and a pipe guide opening 15 are located eccentrically in the first plate 12. Both openings have essentially the shape of a sector of a ring, it being possible for the shape and dimensions of the openings to be different from one another. Instead of two openings, it is also possible to provide only a single opening which extends around the centre of the supply pipe 11 over a sufficiently large angular range.

A retaining element 16 in the form of a wide-meshed screen is attached to the lower end of the supply pipe 11. This prevents flocculations or foreign bodies, which could lead to obstruction of the pourer, entering the supply duct.

A covering element 17 is attached to the upper end of the supply pipe 11. The covering element has a conical guide region 18 which serves for guiding the upper part 3. This is adjoined by a downwardly overhanging apron 19.

The adapter 2 is pushed onto the supply pipe 11. The adapter 2 is held on the lower part 1 by a widening of the lower end of the supply pipe 11 and has an external shape which widens from the bottom to the top. The lower part 1 and the adapter 2 together form a base element suitable for insertion into an opening of a liquid container, in particular into the neck of a bottle.

The upper part 3 comprises a collecting cup 4 and a pouring element 5 connected rigidly to the latter. The pouring element 5 comprises a pouring pipe 51 which is slanted at its upper end and is closed at the lower end by a second plate 52. The pouring pipe 51 and the second plate 52 together delimit a pouring duct 53. Located in the second plate 52 is an eccentric pouring opening 54. This is arranged in such a way that the region of the longest extent of the slanted pouring pipe 51 and the pouring opening 54 are arranged on the same side relative to the centre of the second plate 52. The second plate 52 also has a region 55 which is raised from the plate plane in the direction of the pouring pipe 51 and, on that side of the second plate 52 lying diametrally opposite the pouring opening 54, extends towards and as far as the outer edge. A corresponding, semi-circular cutout 56 is located at the lower end of the pouring pipe 51.

The collecting cup 4 has a conical (funnel-shaped) collecting region 41 for collecting liquid which runs down on the outside of the pouring element 5. Located at the outer edge of the collecting region 41 is an all-round, upwardly extending, annular edge web 42. From the upper edge of this, a covering ring 43, which covers the outer edge region of the collecting region 41, extends inwards. This ensures that, when the pourer is tipped into a pouring position, liquid located in the collecting cup 4 is retained by the edge web 42 and the covering ring 43, so that no liquid can drip out of the collecting cup 4 on the outside.

A third plate 44 with a passage opening 45 of the same shape and size as the pouring opening 54 in the pouring element 5 is located in the centre of the collecting cup 4. The third plate also has a return opening 46. The collecting cup 4 is connected rigidly to the pouring element 5 in such a way that on the one hand the pouring opening 54 and the passage opening 45 come to lie one above another and thus form a common opening and on the other hand the raised region 55 comes to lie above the return opening 46. In this way, the raised region 55 and the third plate 44 together delimit a return duct 57 which extends from the lateral cutout 56 in the pouring pipe 51 to the return opening 46. A return pipe 47 is also attached to the collecting cup 4 in such a way that it follows the return duct 57. The return pipe 47 extends through the pipe guide opening 15 of the first plate 12 into the supply duct 13. In this way, the return duct 57 connects the collecting cup 4 to the supply duct 13 via the return pipe 47.

The upper part 3 is connected swivellably to the lower part 1 by means of a central pin 48 which is attached to the collecting cup 4. The pin thus defines a central swivelling axis 49 in the longitudinal direction of the pourer. In the present embodiment, this coincides with the axes of symmetry of both the supply pipe 11 and the pouring pipe 51. During assembly, the pin is pressed in such a way that on the one hand a secure connection of upper part 3 and lower part 1 is ensured but on the other hand simple rotation of the upper part 3 against the lower part 1 within a swivelling range is possible.

In this connection, the swivelling range is defined by the dimensions of the pipe guide opening 15 in the first plate 12 and the diameter of the return pipe 47, as the return pipe 47 connected rigidly to the upper part 3 is guided through the pipe guide opening 15 and prevents rotation beyond the swivelling range. The swivelling range is preferably roughly 60° to 120°, particularly preferably roughly 80° to 100°, in particular roughly 90°. In order that complete closing of the supply duct 13 is possible, the angular range in which the pouring opening 54 is located should be smaller than or equal to the swivelling range. Accordingly, the pouring opening 54 preferably covers an angular range of roughly 60° to 120°, particularly preferably roughly 80° to 100°, in particular roughly 90° about the centre of the second plate 52.

If only a single opening is present in the first plate 12 instead of the supply and pipe guide openings 14, 15, the swivelling range can, for example, be delimited by projections in the first plate 12 which extend into this opening. This opening should then cover a maximum angular range which is smaller than or equal to 360° minus the angular range the pouring opening 54 covers, in order that closing of the pourer is still possible.

In order to avoid liquid coming out and/or dirt penetrating between lower and upper parts, an O ring 6, which is accommodated in an annular recess in the covering element 17, is located between the conical guide region 18 of the covering element 17 and the underside of the conical collecting region 41 of the collecting cup 4. In particular when the pourer is used as an oil dispenser, the O ring 6 is wetted and lubricated by oil which passes from the supply duct 13 into the gap between the guide region 18 and the collecting region 41. Improved sealing action and easy running of the upper part 3 on the lower part 1 are thus ensured.

The pourer is inserted into a bottle by the adapter 2 being introduced into the bottleneck until the adapter closes the bottleneck with a light contact pressure. The covering element 17 then covers the upper end of the bottleneck on the outside. At the same time, the covering element 17 prevents the pourer being tipped too far laterally by unintentional manipulation and possibly being removed from the bottle in the process. By turning the upper part 3 against the lower part 1, the supply opening 14 on the one hand and the passage opening 45 together with the pouring opening 54 on the other hand are made to overlap at least partly. This brings about a connection in the form of a common opening between the supply duct 13 and the pouring duct 53. The degree of overlap of the openings 14 and 45, 54 (that is the size of the common opening) determines the maximum quantity of liquid which can flow through the pourer per unit of time. In this way, it is possible to dispense the liquid, here in particular the oil. The degree of overlap can be read off on a scale optionally provided on the outside of the apron 19 and/or the edge web 42.

For pouring, the bottle with the pourer is tipped from the vertical in the direction of the horizontal. When used as intended the bottle is then always tipped in such a way that the region of the longest extent of the slanted pouring pipe 51, and thus the pouring opening 54 as well, comes to lie towards the bottom. The slant of the pouring pipe 51 therefore serves not only for simplified pouring but also as an optical aid in order to select the correct tipping direction of the bottle intuitively.

The pourer illustrated combines a number of advantages: the pourer meets high hygienic requirements as liquid which passes back into the bottle through the return duct 57 from the collecting cup 4 does not come into contact with parts of the pourer which are movable against one another. In this way, liquid is prevented from entering regions of the pourer which are difficult to clean and there possibly coming into contact with dirt.

The return pipe 47 is connected rigidly to the upper part 3. It can thus be ensured that the return pipe 47 always comes to lie at the top, irrespective of the relative position of the lower and upper parts, when the bottle is tipped into the horizontal for a pouring operation. On the one hand, in this way, liquid passing from the bottle to the outside through the return pipe 47 and the return duct 57 is avoided. This is achieved here by the return duct 57 and the return pipe 47 being arranged on the diametrally opposite side of the pouring opening 54. Other orientations of the return duct 57 are also possible, however, in particular when a curved return pipe is used. On the other hand, the return pipe lying on the top leads to good flow properties of the liquid while being poured and thus to a good optical appearance of the flow. For the flow properties, among other factors, the distance between the pouring opening 54 and the return pipe 47 is important. The larger this distance, the better the flow will be. Furthermore, air streaming through the return pipe into the bottle during pouring should be directed away from the liquid to be poured as far as possible in order not to disturb the liquid flow. These requirements are also fulfilled by providing the return pipe 47 diametrally opposite of the pouring opening 54.

All parts of the pourer, with the exception of the adapter 2 and the O ring 6, are preferably made of metal, particularly preferably of stainless steel. Alternatively, manufacture from a synthetic material is possible.

The adapter 2 is made from a material which ensures good sealing against glass and a good grip on glass, even in the presence of edible oil. The adapter 2 is preferably made from an oil-resistant elastomer such as silicone or Santoprene™. In particular for the use of the pourer for liquids other than edible oils, other elastomeric synthetic materials can be used. The retention of the adapter 2 in the bottleneck is further improved by several steps being located in the outer surface of the adapter 2. This allows the pourer to be inserted into the necks of a variety of bottles available commercially, with different inner diameters of their necks.

The O ring 6 is made from a foodsafe and oil-resistant rubber material.

As the pourer is to be used for foods, all rigid connections between different parts of the pourer, at least in regions which come into contact with liquid, are preferably made without adhesive. Individual or all connections are preferably made by welding, it being possible to use known welding techniques, e.g., conventional point welding or laser welding.

The dimensions of the pourer illustrated are selected in such a way that it is suitable for dispensing edible oil from a customary household oil bottle. The inside diameter of the supply pipe 11 and also of the pouring pipe is therefore preferably roughly 15 millimeters with a wall thickness of roughly 0.5 millimeters, the radial extent of the supply and pouring openings 14, 54 is in each case roughly 4 millimeters, and the angular range covered by these openings and the swivelling range are roughly 90°. The outside diameter of the collecting cup 4 and also of the covering element 17 is roughly 40 mm, the length of the supply pipe roughly 34 millimeters, and the length of the pourer overall roughly 62 millimeters. The adapter 2 widens from roughly 20 millimeters to roughly 28 millimeters in steps of roughly 0.8 millimeter so as to fit into the neck of oil bottles with neck widths of different size.

Variations of these dimensions are of course possible, for example in the range of plus or minus 50%, in order to modify the pourer for other bottle sizes or other areas of application.

The pourer illustrated is in its material selection and its dimensions designed specially for use for dispensing edible oil. Instead of this, the pourer can also be designed for other liquids, in particular for other liquids in the food sector such as, for example, vinegar, soy sauce, coffee cream, spirits etc. In the case of, for example, design for use with household vinegar, it is then to be ensured that all parts coming into contact with the vinegar are acid-resistant.

LIST OF REFERENCE NUMBERS

1 lower part
2 adapter
3 upper part
4 collecting cup
5 pouring element
6 O ring
11 supply pipe
12 first plate
13 supply duct
14 supply opening
15 pipe guide opening
16 retaining element (screen)
17 covering element
18 conically tapering region
19 apron
41 collecting region
42 edge web
43 covering ring
44 third plate
45 passage opening
46 return opening
47 return pipe
48 pin
49 swivelling axis
51 pouring pipe
52 second plate
53 pouring duct
54 pouring opening
55 raised region
56 cutout
57 return duct

The invention claimed is:

1. A pourer for a liquid container, comprising:

a base element with a supply duct, a pouring element with a pouring duct, the pouring element and the base element being interconnected swivellably about a common axis in such a way that there is a swivelling range in which the supply duct and the pouring duct communicate with one another, a collecting cup surrounding the pouring element at least partly and being connected rigidly to the pouring element, and a return means for returning liquid from the collecting cup into the liquid container.

2. The pourer according to claim 1, wherein the return means connects the collecting cup to the supply duct.

3. The pourer according to claim 1 or 2, wherein the return means comprises a return pipe which is connected rigidly to the collecting cup and the pouring element and extends into the supply duct.

4. The pourer according to claim 1, wherein the supply duct is closed by a first plate which has a supply opening, wherein the pouring duct is closed by a second plate which is parallel to the first plate and has a pouring opening, and wherein there is a swivelling range in which the supply opening and the pouring opening overlap one another at least partly in order to interconnect the supply duct and the pouring duct.

5. The pourer according to claim 4, wherein the pouring element has a lateral cutout adjacent to the collecting cup, and wherein the return means comprises a return duct which, starting from this lateral cutout, extends into the supply duct.

6. The pourer according to claim 5, wherein a third plate, which is connected rigidly to the second plate and has a passage opening, which overlaps at least partly with the pouring opening, and a return opening, is arranged between the second plate and the first plate, and wherein the second plate has a region which is raised from the third plate, extends from the return opening as far as an outer edge region of the second plate, and together with the third plate delimits the return duct.

7. The pourer according to claim 1, wherein the collecting cup has a funnel-shaped collecting region for liquid.

8. The pourer according to claim 1, wherein the collecting cup has a collecting region for liquid and a covering region which partly covers the collecting region.

9. The pourer according to claim 1, wherein the base element comprises an adapter element which is made from an elastomeric material, has a conically tapering external shape and is suitable for being introduced into and sealing the neck of a bottle.

10. The pourer according to claim 1, wherein an O ring is arranged between the collecting cup and the base element in such a way that the O ring can be wetted by liquid which enters between the collecting cup and the base element.

* * * * *